US007289095B2

(12) United States Patent
Park et al.

(10) Patent No.: US 7,289,095 B2
(45) Date of Patent: Oct. 30, 2007

(54) LIQUID CRYSTAL DISPLAY AND DRIVING METHOD THEREOF

(75) Inventors: Jheen-Hyeok Park, Seongnam (KR); Sin-Gu Kang, Suwon (KR); Nam-Soo Kang, Ansan (KR); In-Yong Hwang, Yongin (KR); Ji-Hoon Kim, Yongin (KR); Sun-Kyu Son, Suwon (KR); Gyu-Su Lee, Suwon (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 469 days.

(21) Appl. No.: 10/690,805

(22) Filed: Oct. 21, 2003

(65) Prior Publication Data

US 2004/0135757 A1 Jul. 15, 2004

(30) Foreign Application Priority Data

Oct. 21, 2002 (KR) ..... 10-2002-0064184

(51) Int. Cl.
*G09G 3/36* (2006.01)
*G09G 5/00* (2006.01)

(52) U.S. Cl. ..... 345/98; 345/87; 345/204; 345/211

(58) Field of Classification Search ..... 345/87–104, 345/204–214, 690
See application file for complete search history.

(56) References Cited

U.S. PATENT DOCUMENTS 5,764,225 A 6/1998 Koshobu ..... 345/211
6,429,841 B1 8/2002 Lee ..... 345/89
6,480,180 B1 * 11/2002 Moon ..... 345/98
2002/0154104 A1 10/2002 Inoue et al. ..... 345/204
2003/0043100 A1 * 3/2003 Moon ..... 345/87
2003/0193459 A1 * 10/2003 Kim et al. ..... 345/87

FOREIGN PATENT DOCUMENTS

CN 1180418 4/1998
CN 1363080 8/2002
JP 06-295162 1/1994

(Continued)

OTHER PUBLICATIONS

European Search Report issued by the European Patent Office for application No. 03023873.7-2205 dated Sep. 9, 2005.

(Continued)

*Primary Examiner*—David L. Lewis
(74) *Attorney, Agent, or Firm*—MacPherson Kwok Chen & Heid LLP

(57) ABSTRACT

A liquid crystal display is provided, which includes: a liquid crystal panel including a plurality of pixels including switching elements, a plurality of gate lines for transmitting gate signals to the switching elements, and a plurality of data lines for transmitting data voltages to the pixels; a data driver including a plurality of data driving ICs connected to respective sets of the data lines, receiving image data, and applying the data voltages corresponding to the image data to the data lines; and a gate driver applying the gate voltages to the gate lines, wherein the data driving ICs are supplied with a ground voltage and a supply voltage and voltage levels of the image data swing with reference to a reference voltage lower than the supply voltage.

16 Claims, 5 Drawing Sheets

FOREIGN PATENT DOCUMENTS

| | | |
|---|---|---|
| JP | 07-121139 | 5/1995 |
| JP | 07-271323 | 10/1995 |
| JP | 08-254684 | 10/1996 |
| JP | 08-320465 | 12/1996 |
| JP | 09-068949 | 3/1997 |
| JP | 09-081086 | 3/1997 |
| JP | 10-020837 | 1/1998 |
| JP | 10-214063 | 8/1998 |
| JP | 10-222136 | 8/1998 |
| JP | 10-268838 | 10/1998 |
| JP | 10-268844 | 10/1998 |
| JP | 2001-324967 | 11/2001 |
| KR | 1019990047689 | 5/1999 |
| KR | 1020020049813 | 6/2002 |
| WO | WO 01/57837 | 8/2001 |

OTHER PUBLICATIONS

English Language Abstract, CN Patent First Publication No. CN1363080, Aug. 7, 2002, 1 page.

English Language Abstract, CN Patent First Publication No. CN1180418, Apr. 29, 1998, 1 page.

English Language Abstract, JP Patent First Publication No. 06-295162, Oct. 21, 1994, 1 page.

English Language Abstract, JP Patent First Publication No. 07-121139, May 12, 1995, 1 page.

English Language Abstract, JP Patent First Publication No. 07-271323, Oct. 20, 1995, 1 page.

English Language Abstract, JP Patent First Publication No. 08-254684, Jan. 1, 1996, 1 page.

English Language Abstract, JP Patent First Publication No. 08-320465, Dec. 3, 1996, 1 page.

English Language Abstract, JP Patent First Publication No. 09-068949, Mar. 11, 1997, 1 page.

English Language Abstract, JP Patent First Publication No. 09-081086, Mar. 28, 1997, 1 page.

English Language Abstract, JP Patent First Publication No. 10-020837, Jan. 23, 1998, 1 page.

English Language Abstract, JP Patent First Publication No. 10-214063, Aug. 11, 1998, 1 page.

English Language Abstract, JP Patent First Publication No. 10-222136, Aug. 21, 1998, 1 page.

English Language Abstract, JP Patent First Publication No. 10-268838, Oct. 9, 1998, 1 page.

English Language Abstract, JP Patent First Publication No. 10-268844, Oct. 9, 1998, 1 page.

English Language Abstract, JP Patent First Publication No. 2001-324967, Nov. 22, 2001, 1 page.

English Language Abstract, KR Patent First Publication No. 1020020049813, Jun. 26, 2002, 1 page.

English Language Abstract, KR Patent First Publication No. 1019990074689, May 10, 1999, 1 page.

* cited by examiner

LIQUID CRYSTAL DISPLAY AND DRIVING METHOD THEREOF

RELATED APPLICATION

This patent application claims priority from Korean Patent Application No. 2002-0064184 filed on Oct. 21, 2002, which is incorporated herein by reference in its entirety.

BACKGROUND OF THE INVENTION (a) Field of the Invention

The present invention relates to a liquid crystal display and a driving method thereof.

(b) Description of Related Art

A liquid crystal display (LCD) is one of the most prevalent flat panel displays, which includes two panels having a plurality of electrodes for generating electric field, a liquid crystal (LC) layer interposed therebetween, and two polarization films attached to outer surfaces of the two panels. The LCD varies voltages applied to the field-generating electrodes to re-orient LC molecules in the LC layer, which determine polarization of light passing through the LC layer. The polarization films changes transmittance of the light based on the variation of the light polarization. Therefore, desired images are obtained by controlling the voltages applied to the field-generating electrodes. One of the panels includes thin film transistors (TFTs) for switching the voltages applied to the field-generating electrodes.

In the center of the panel on which the TFTs are formed, a display area on which an intended image is displayed is placed. In the display area, a plurality of signal lines, that is, a plurality of gate lines and data lines are formed in row and column directions, respectively. In a pixel area, which is defined by the crossing of the gate line and data line, a pixel electrode is formed, and the TFT controls the data signal transmitted via the data line according to the gate signal transmitted via the gate line to provide it to the pixel electrode.

A plurality of gate pads and data pads, which are connected to the gate lines and data lines, respectively, are formed outside the display area, and those pads are connected to external driving ICs to receive the gate signals and data signals from the outside and transmit them to the gate lines and data lines.

To transmit the gate signal and data signal, a gate printed circuit board ("PCB") and a data PCB are attached to the TFT panel through a thermal press process using an anisotropic conducting film ("ACF"). Connected between the TFT panel and the data PCB is a flexible printed circuit ("FPC") for data signal transmission on which a data driving IC that transforms an electric signal to a data signal and outputs it to the data pad and data line is mounted. Also, connected between the TFT panel and the data PCB is an FPC for gate signal transmission on which a gate driving IC that transforms an electric signal to a gate signal and outputs it to the gate pad and gate line is mounted.

The structure that the data driving IC and gate driving IC are connected to the TFT panel and PCB via transmission film has disadvantages that additional mounting space are required between the TFT panel and PCB for placing the IC to the transmission film to make the overall size larger and that contact defect may be generated due to the attachment of the IC to the transmission film.

To solve the above problems, a chip on class ("COG") structure in which the data IC and/or gate IC is mounted directly on the TFT panel and the IC and the PCB are connected using the transmission film is used.

However, in case that at least two data ICs are mounted on the TFT panel in the COG type LCD, since a plurality of transmission films, on which data wiring for transmitting signal data, control data, and gray data received from the signal controller of the PCB are formed, are arranged in parallel, it causes disadvantages that manufacturing cost increases due to the use of many expensive transmission films and that mounting space for connecting the transmission film to each data IC is required.

In addition, the large number of the connections between data ICs and transmission films causes disadvantages of high cost and high contact defect rate.

A cascade structure, in which a data signal is provided by connecting a transmission film to one side and the signal provided from one side is provided to each data IC arranged in parallel by a shift operation of the data IC, is suggested to resolve the above disadvantages.

However, in the conventional LCD having such a cascade structure or another, a data controller circuit of the PCB transmits data to the data driving IC using RSDS (Reduced Swing Differential Signal) or conventional TTL method. For example, in case that 6-bit data are transmitted, since R, G, and B data with clock signal should be transmitted separately in TTL level transmission method, total nineteen (19) signal lines (clock signal line (1)+respective signal lines (6*3)=19) are required.

In addition, in case of RSDS transmission method, since the signals of positive and negative polarities for each signal are transmitted simultaneously, total twenty (20) signal lines (clock signal line (2)+respective signal lines (9*2)=20) are required.

As described above, even though a cascade structure is used, still there is a disadvantage that the number of the signal lines increase, and therefore, the possibility of noise increase becomes higher due to the influences between signal lines.

SUMMARY OF THE INVENTION

According to an aspect of the present invention, a liquid crystal display is provided, which includes: a liquid crystal panel including a plurality of pixels including switching elements, a plurality of gate lines for transmitting gate signals to the switching elements, and a plurality of data lines for transmitting data voltages to the pixels; a data driver including a plurality of data driving ICs connected to respective sets of the data lines, receiving image data, and applying the data voltages corresponding to the image data to the data lines; and a gate driver applying the gate signals to the gate lines, wherein the data driving ICs are supplied with a ground voltage and a supply voltage and voltage levels of the image data swing with reference to a reference voltage lower than the supply voltage.

The data driving ICs may be mounted on the liquid crystal panel.

Preferably, the image data received by the data driver are first inputted into at least one of the data driving ICs and shifted to other data driving ICs. The data driving ICs may include first and second sets of data driving ICs and the image data include first and second image data to be inputted into the first and the second sets of data driving ICs, respectively.

It is preferable that each of the first and the second sets of data driving ICs include one data driving IC receiving the image data from an external device.

The image data for a data driving IC farther from the one data driving IC receiving the image data from the external device preferably precede the image data for a data driving IC closer to the one data driving IC receiving the image data from the external device.

The liquid crystal display may further include a voltage generator for generating the reference voltage to be provided for the data driver and for generating voltages required for the gate signals to be provided for the gate driver. The voltage generator may further generate a plurality of gray voltages to be supplied to the data driver and to be selected as the data voltages.

The reference voltage may be inputted to the data driving ICs simultaneously.

A signal line for transmitting the reference voltage may be provided on the liquid crystal panel.

The image data preferably have a voltage swing level lower than a voltage swing level of a signal transmitted in TTL/CMOS (transistor-transistor logic/complementary metal oxide semiconductor) transmission.

The gate driver may include a plurality of gate driving ICs connected to respective sets of gate lines.

A method of driving a liquid crystal display including a liquid crystal panel having a plurality of pixels, a plurality of gate lines, and a plurality of data lines, a data driver including a plurality of data driving ICs for supplying data voltages to the data lines, and a gate driver for supplying gate signals to the gate lines is provided, which includes inputting the image data to at least one of the data driving ICs; and shifting the image data to the data driving ICs, wherein the data driving ICs are supplied with a ground voltage and a supply voltage and voltage levels of the image data swing with reference to a reference voltage lower than the supply voltage.

The shift direction of the image data may be two.

BRIEF DESCRIPTION OF THE DRAWINGS

The present invention will become more apparent by describing preferred embodiments thereof in detail with reference to the accompanying drawings in which.

DETAILED DESCRIPTION OF THE PREFERRED EMBODIMENTS

The present invention now will be described in more detail hereinafter with reference to the accompanying drawings, in which preferred embodiments of the invention are shown.

Now, liquid crystal displays and driving methods thereof will be described in detail with reference to the accompanying drawings.

Figure 1:
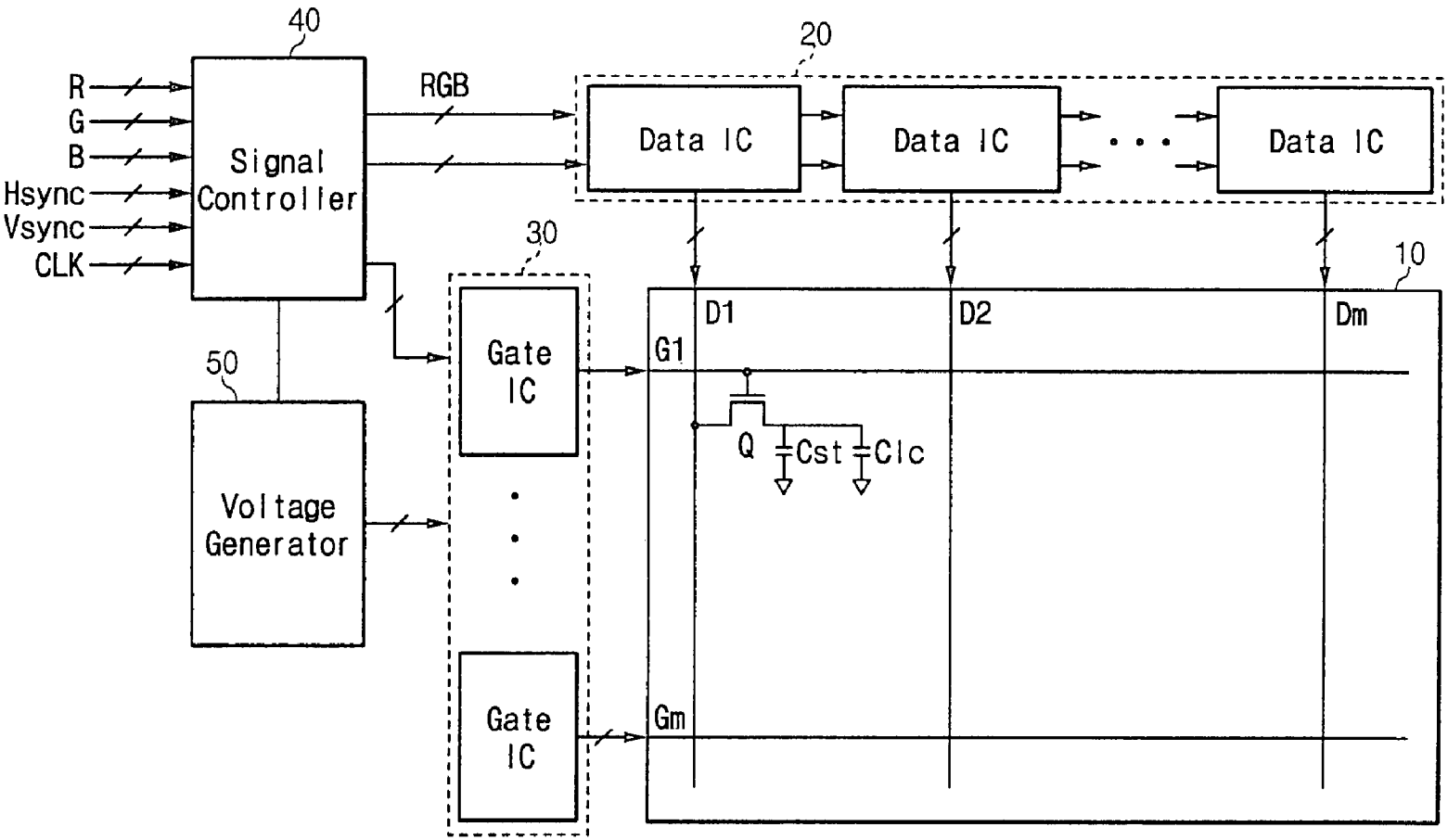
FIG. 1 is a block diagram of an LCD according to an embodiment of the present invention.

FIG. 1 is a block diagram of an LCD according to an embodiment of the present invention.

The LCD according to an embodiment of the present invention includes, as shown in FIG. 1, a LC panel 10, a data driver 20, a gate driver 30, a signal controller 40, and a voltage generator 50.

The liquid crystal panel 10 includes a plurality of gate lines G1-Gn for transmitting gate signals, a plurality of data lines D1-Dm intersecting the gate lines G1-Gn for transmitting data voltages, and a plurality of pixels arranged in a matrix pattern and connected to the gate lines G1-Gn and the data lines D1-Dm.

Each pixel includes a switching element Q, a LC capacitor Clc, and a storage capacitor Cst. The switching element Q such as a TFT has three terminals: a control terminal connected to one of the gate lines G1-Gn; an input terminal connected to one of the data lines D1-Dm; and an output terminal to the LC capacitor Clc and the storage capacitor Cst. The LC capacitor Clc is supplied with a data voltage and a common voltage, while the storage capacitor Cst is supplied with the data voltage and a predetermined voltage such as the common voltage.

The signal controller 40 receives image data and input control signals from an external graphics source, and it processes the image data and generates controls signals based on the input image data and the input control signals.

The data driver 20 shifts and stores the image data serially inputted from the signal controller 40, and it selects the data voltages corresponding to the respective image data in response to a control signal called "a load signal" from the signal controller 40 and applies the data voltages to the data lines D1-Dm of the LC panel 10.

The gate driver 30 generates the gate signals including a gate-on voltage for turning on the switching elements Q of the pixels and a gate-off voltage for turning off the switching elements Q, and it applies the gate signals to the gate lines G1-Gn of the LC panel 10. The gate driver 30 includes a plurality of gate driving ICs mounted on the LC panel 10 or on a transmission film (not shown) attached to the LC panel 10.

The voltage generator 50 generates the gate-on voltage, the gate-off voltage, and a common voltage Vcom, and it also generates gray voltages related to the transmittance of the pixels. In addition, the voltage generator 50 generates a reference voltage Vref for data transmission.

An exemplary detailed configuration of the LCD shown in FIG. 1 will now be described in detail with reference to FIG. 2.

Figure 2:
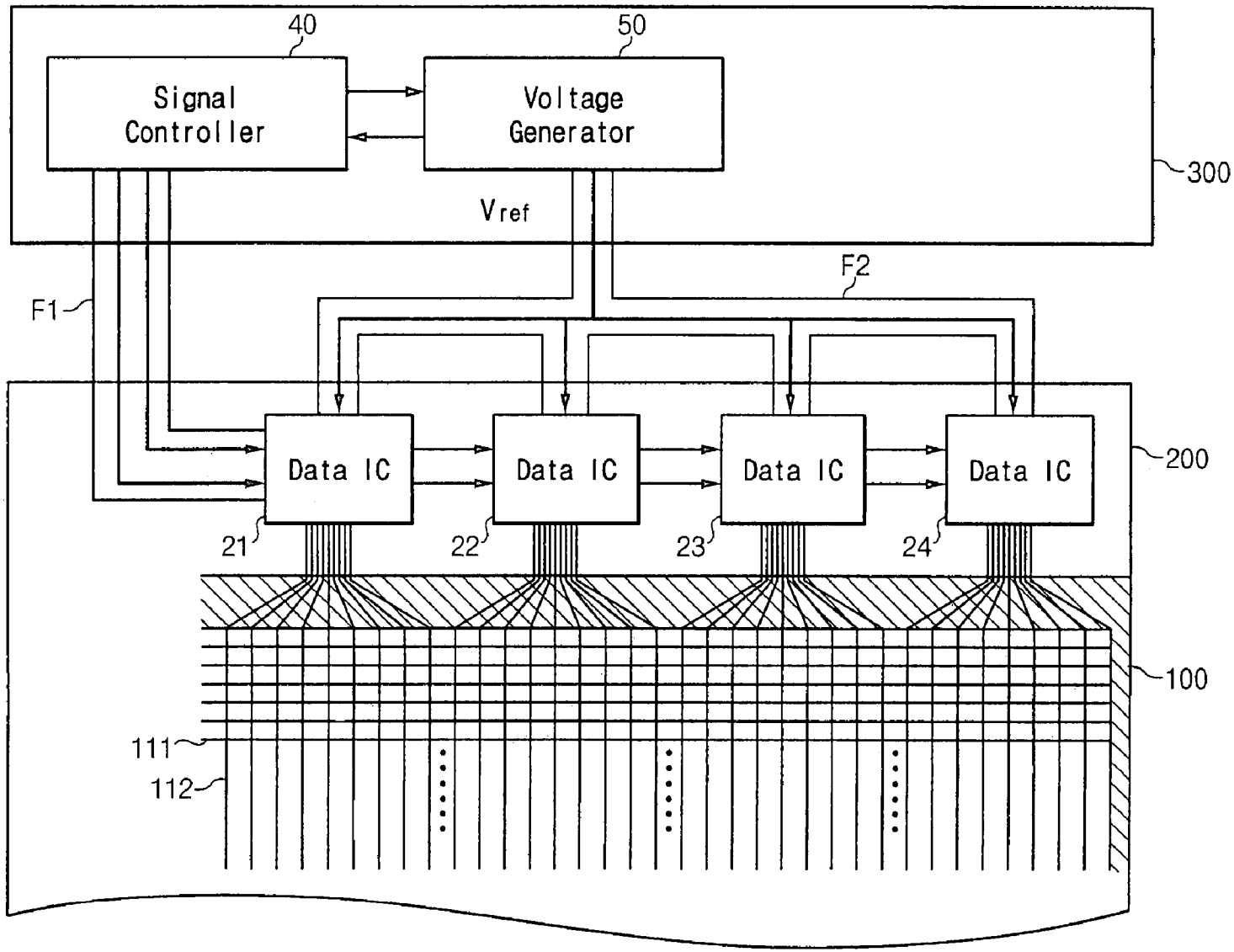
FIG. 2 is a schematic diagram of an LCD according to an embodiment of the present invention.

FIG. 2 is a schematic diagram of an LCD according to an embodiment of the present invention, which shows connections among a signal controller, a voltage generator, and a data driver.

Referring to FIG. 2, an LCD according to an embodiment of the present invention includes an upper panel 100 and a TFT array panel 200 facing each other, a printed circuit board 300 located adjacent to the upper panel 100, a plurality of data driving ICs 21-24 mounted on a peripheral area of the TFT panel 200 in so called a chip on glass type, and first and second transmission films F1 and F2 connected between the PCB 300 and the data driving ICs 21-24.

A plurality of signal lines such as a plurality of gate lines 111 and a plurality of data lines 112 are provided on a display area, which occupies most of the TFT array panel 200. The gate lines 111 and the data lines 112 extend in row and column directions, respectively, and the data lines 112 are grouped to be connected to the respective data driving ICs 21-24.

A plurality of circuit elements such as a signal controller 40 and a voltage generator 50 are provided on the PCB 300.

The signal controller 40 is electrically connected to a first one 21 of the data driving ICs 21-24 via transmission lines of the first transmission film F1 for data transmission of image data and the voltage generator 50 is electrically connected to the data driving ICs 21-24 via transmission lines of the second transmission film F2 for voltage transmission of a reference voltage Vref and of gray voltages (not shown). In detail, there are also provided a plurality of transmission lines, although they are not shown in the figures, on the PCB 300 for the image data transmission between the signal controller 40 and the first transmission film F1 and for the voltage transmission between the voltage generator 50 and the second transmission film F2. In addition, there are provided on the TFT array panel 200 a plurality of other transmission lines (not shown) for data or voltage transmission between the first and the second transmission films F1 and F2 and the data driving ICs 21-24 and for data transmission between the data driving ICs 21-24.

The first and the second transmission films F1 and F2 are physically and electrically connected to the TFT panel 200 and the PCB 300 through thermal pressing process using anisotropic conducting film (ACF) (not shown).

The image data from the signal controller 40 are inputted into the first data driving IC 21 via the first transmission film F1. The image data are shifted and stored in the data driving ICs 21-24 in sequence and thus the image data are transmitted from the signal controller 40 to the last data driving IC 24 via the previous data driving ICs 21-23.

In the meantime, the reference voltage Vref is transmitted to the data driving ICs 21-24 via the second transmission film F2 simultaneously.

Alternately, the voltage generator 50 is electrically connected only to the first data driving IC 21 like the connection between the signal controller 40 and the first data driving IC 21, and the reference voltage Vref and/or the gray voltages are transmitted to the remaining ICs 22-24 in sequential manner.

Figure 3:
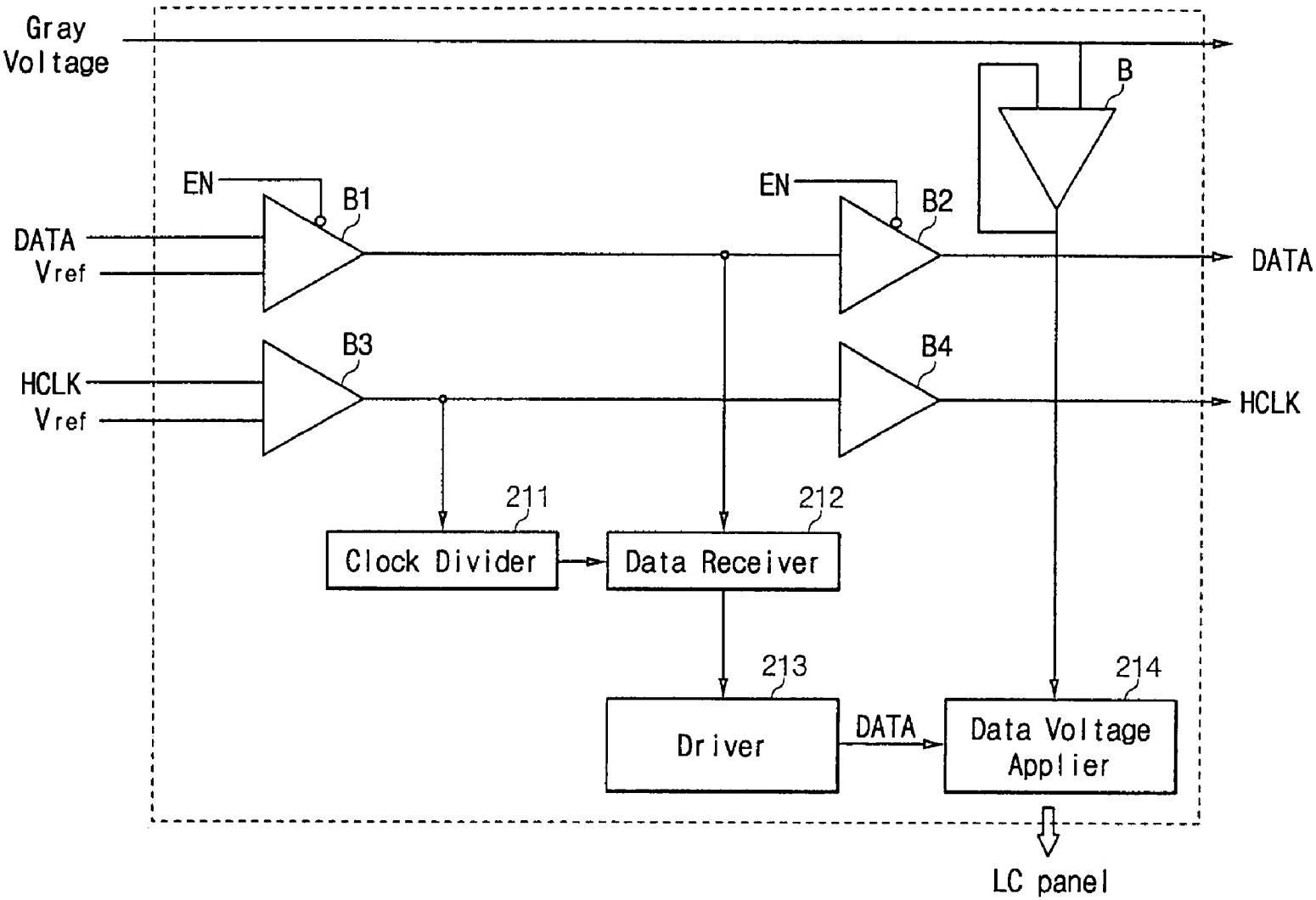
FIG. 3 is an exemplary circuit diagram of a data driving IC shown in FIG. 2 according to an embodiment of the present invention.

FIG. 3 is an exemplary circuit diagram of a data driving IC shown in FIG. 2 according to an embodiment of the present invention.

Referring to FIG. 3, a data driving IC includes a pair of input buffers B1 and B3, another input buffer B receiving a plurality of gray voltages, a pair of output buffers B2 and B4, a clock divider 211 connected to the input buffer B1, a data receiver 212 connected to the input buffer B1 and the clock divider 211, a driver 213 connected to the data receiver 212, and a data voltage applier 214 connected to the driver 213 and the input buffer B.

The input buffer B1 receives image data DATA from a signal controller 40 or a previous data driving IC and a reference voltage Vref from a voltage generator 50 shown in FIG. 2. The input buffer B1 is also supplied with an input/output control signal EN from the signal controller 40.

The input buffer B3 receives a clock HCLK from the signal controller 40 or the previous data driving IC and the reference voltage Vref from the voltage generator 50.

The clock divider 211 receives the clock HCLK from the input buffer B3 and frequency-divides the input clock HCLK.

The data receiver 212 receives the image data DATA from the input buffer B1 according to the frequency-divided clock from the clock divider 211.

The driver 213 receives the image data DATA from the data receiver 212 and transmits the image data DATA to the data voltage applier 214.

The data voltage applier 214 receives the image data DATA from the driver 213 and the gray voltages from the input buffer B and converts the image data into respective data voltages selected among the gray voltages. The data voltage applier 214 outputs the data voltages to corresponding data lines 112 of an LC panel 10.

The output buffer B2 receives the image data DATA from the input buffer B1 and the input/output control signal EN from the signal controller 50 and outputs the image data DATA to a next data driving IC in accordance with the control signal EN.

The output buffer B4 receives the clock HCLK from the input buffer B3 and outputs the clock HCLK to the next data driving IC.

Next, the operation of an LCD shown in FIGS. 2 and 3 is described with reference to FIGS. 2, 3 and 4.

Figure 4:
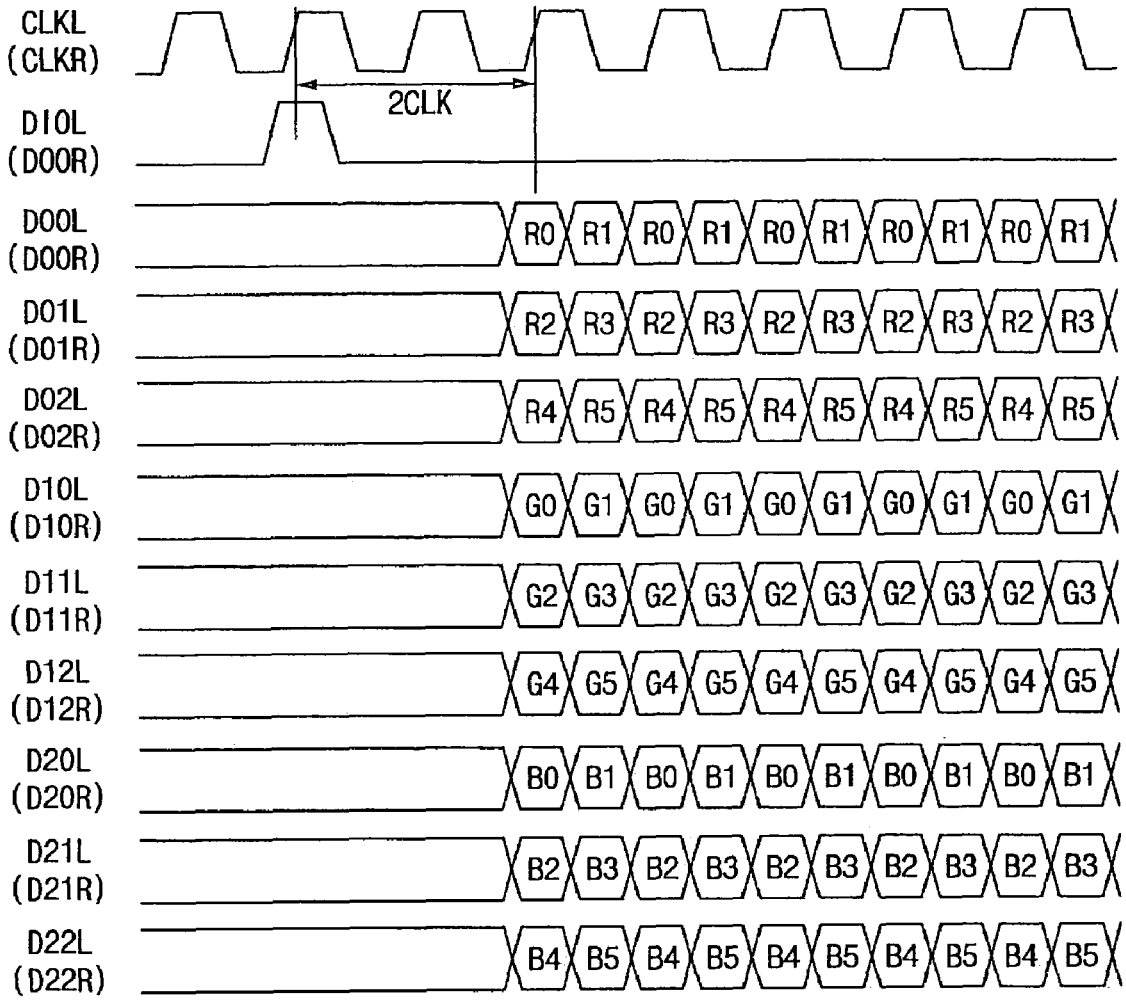
FIG. 4 is a timing chart of image data of an LCD according to an embodiment of the present invention.

FIG. 4 is a timing chart of image data of an LCD according to an embodiment of the present invention.

The signal controller 40 receives image data inputted from an external signal source (not shown), processes the input image data, and generates various control signals for displaying the processed image data.

The control signals generated by the signal controller 40 include a clock HCLK swinging on the basis of the reference voltage Vref.

Every bit of the image data processed by the signal controller 40 has high and low voltage levels and the voltage difference between the high level and the low level is about 1.0 volt, which is relatively small compared with the voltage difference of about 3.3 volts for a TTL type and relatively large compared with the voltage difference of about 0.2 volts for an RSDS type. For example, the high and low levels of the image data are equal to the reference voltage Vref added by about ±0.5 volts, respectively.

In addition, the reference voltage Vref is lower than a higher supply voltage provided for the data driving ICs 21-24, which are supplied with two supply voltages, the high supply voltage and a low supply voltage such as a ground voltage.

TABLE 1 shows an example of high and low levels of image data according to an embodiment of the present invention.

TABLE 1

| Symbol | Parameter | Minimum | Standard | Maximum | Unit |
|---|---|---|---|---|---|
| Voh | High Level | Vref + 400 | Vref + 500 | | mV |
| Vref | Reference Voltage | — | 1.0 V | — | mV |
| Vol | Low Level | | Vref − 500 | Vref − 400 | mV |

As shown in TABLE 1, the image data according to an embodiment of the present invention is switched in a range of maximum 1.5V to minimum 0.5V with reference to the reference voltage Vref of 1.0V.

The signal controller 40 transmits the image data for red, green and blue colors in parallel to the data driver 20 and every two bits of each of the R, G, and B image data are transmitted through one signal line as shown in FIG. 4. For example, image data bits R0 and R1 are synthesized and outputted through one signal line. Therefore, three signal lines are required for the data transmission of each 6-bit image data for red, green or blue color.

Accordingly, the total number of signal lines required for transmitting 6-bit image data is eleven, one for the clock signal HCLK, one for the reference signal Vref, and nine for the red, green, and blue image data. Therefore, the number of the signal lines according to an embodiment of the present invention can be remarkably reduced compared with conventional RSDS or TTL.

The data transmission according to an embodiment of the present invention is named as LVCC (low voltage cascade connection) type because a plurality of data driving ICs formed in a COG type are connected in a cascade type and the low voltage image data swing with reference to the reference voltage Vref.

The signal controller 40 sends the processed image data DATA and the clock signal HCLK to the first data driving IC 21 on the TFT panel 200 through the first transmission film F1. In addition, the voltage generator 50 provides the reference voltage Vref and the gray voltages for the data driving ICs 21-24 through the second transmission film F2.

The input buffer B1 receives the image data DATA and the reference signal Vref and outputs the image data DATA in response to the input/output control signal EN. Likewise, the input buffer B3 receives the clock signal HCLK and the reference signal Vref and outputs the clock signal HCLK.

The clock divider 211 frequency-divides the clock HCLK from the input buffer B3 and the data receiver 212 stores the image data DATA from the input buffer B1 according to the frequency-divided clock from the clock divider 211. The data voltage applier 214 converts the image data DATA into data voltages selected from the gray voltages supplied from the input buffer B and outputs the data voltages to corresponding data lines D1-Dm of the LC panel 10 under the control of the driver 213.

In the meantime, the output buffer B2 receives the image data DATA from the input buffer B1 and outputs the image data DATA to the next data driving IC in response to the input/output control signal EN. Likewise, the output buffer B4 receives the clock signal HCLK from the input buffer B2 and outputs the clock signal HCLK to the next data driving IC.

In this way, each data driving IC applies the data voltages to the corresponding data lines D1-Dm and transmits the image data DATA to the next driving IC.

In the meantime, the gate driver 30 generates gate signals and applies the gate signals to the gate lines G1-Gn in sequence to turn on the switching elements of the pixels connected to the gate lines G1-Gn. Then, the data voltages flowing in the data lines D1-Dm are transmitted to the pixels via the activated switching elements.

The voltage difference across the liquid crystal capacitor Clc determines the orientations of the LC molecules in the liquid crystal layer, which in turn determines the polarization of incident light and the light polarization is converted into transmittance the light by the polarizers, thereby displaying desired images.

According to another embodiment of the present invention, the image data are inputted to two data driving ICs such as the first data driving IC and the last data driving IC and shifted toward the center.

According to another embodiment of the present invention, the levels of the image data entering into the data driving ICs are the same in order for preventing the signal delay and voltage drop of the image data due to long signal paths.

Figure 5:
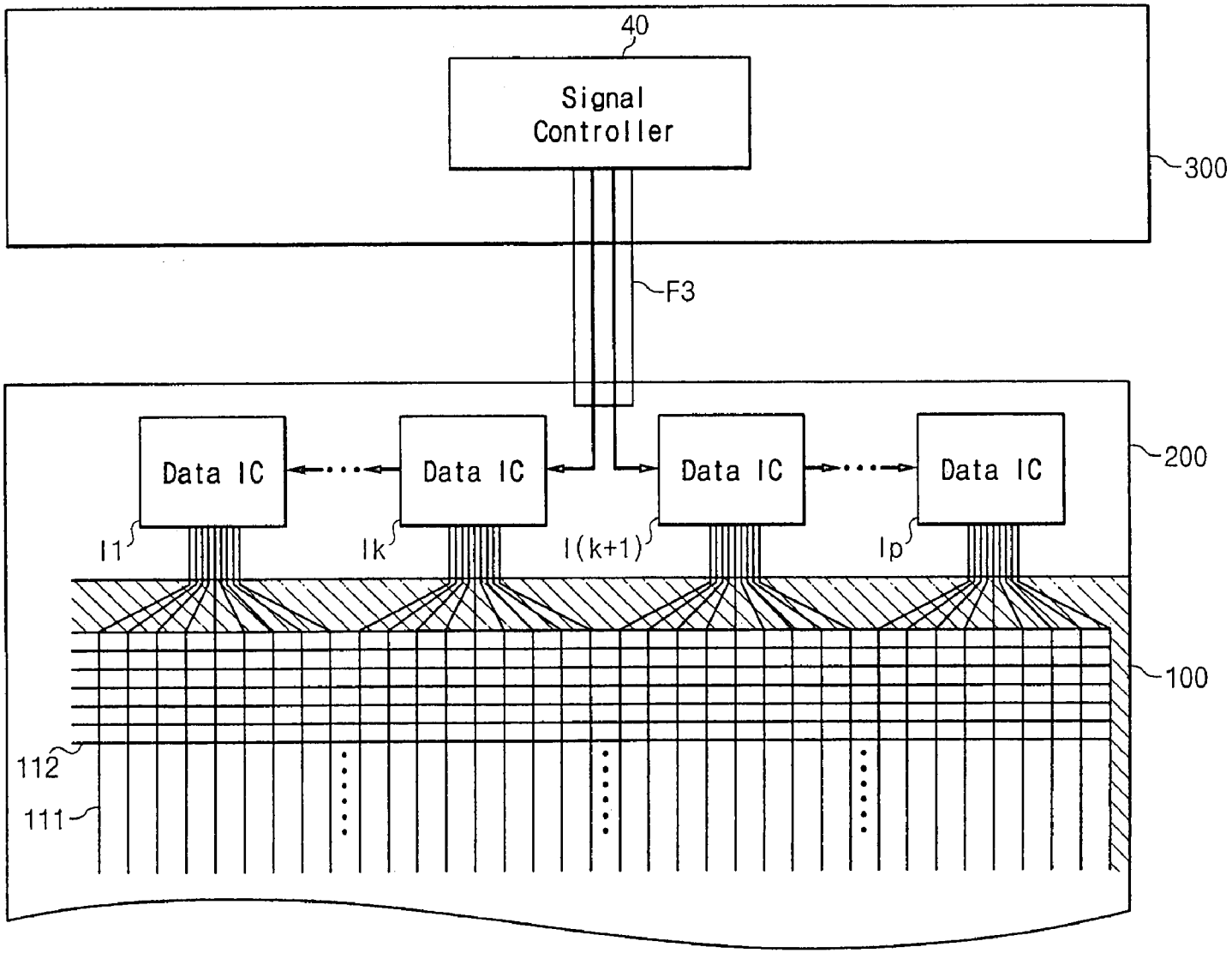
FIG. 5 is a schematic diagram of an LCD according to another embodiment of the present invention.

FIG. 5 is a schematic diagram of an LCD according to another embodiment of the present invention.

Referring to FIG. 5, an LCD according to another embodiment of the present invention includes an upper panel 100 and a TFT array panel 200 facing each other, a printed circuit board 300 located adjacent to the upper panel 100, a plurality of (n) data driving ICs I1-Ip mounted on the TFT panel 200, and a transmission film F3 connected between the PCB 300 and the data driving ICs I1-Ip.

A plurality of gate lines 111 and a plurality of data lines 112 are provided on the TFT array panel 200. The gate lines 111 and the data lines 112 extend in row and column directions, respectively, and the data lines 112 are grouped to be connected to the respective data driving ICs I1-Ip.

A signal controller 40 is provided on the PCB 300. The signal controller 40 is electrically connected to intermediate two driving ICs Ik and I(k+1) (1<k<p) among the data driving ICs I1-Ip via first and second transmission lines of the transmission film F3 for data transmission of image data, respectively. The number k is preferably equal to about p/2.

The image data from the signal controller 40 are inputted into the k-th and the (k+1)-th data driving IC Ik and I(k+1) via the transmission film F3. The image data entering into the k-th data driving IC Ik are shifted to the first data driving IC I1, while image data entering into the (k+1)-th data driving IC I(k+1) are shifted to the last data driving IC Ip. The former image data are referred to as first image data and the latter image data are referred to as second image data for descriptive convenience.

Since a signal path of the first image data for the first to the k-th data driving ICs I1-Ik is reversed to a signal path of the second image data for the (k+1)-th to the n-th data driving ICs I(k+1)-In, the signal controller 40 outputs the first image data in forward order and the second image data in reverse order. For example, it is assumed that first image data for the first to the fourth data drivers are A, B, C and D, respectively, while E, F, G and H are second image data for the fifth to the eighth data drivers, respectively, when p=8 and k=4. The signal controller 40 outputs the first image data in order of A, B, C and D, while it outputs the second image data in order of H, G, F and E. Then, the image data A are transmitted to the first data driving IC via the second to fourth driving ICs, the image data B are transmitted to the second data driving IC via the third and fourth driving ICs, and so on. Likewise, the image data H are transmitted to the eighth data driving IC via the fifth to seventh driving ICs, the image data G are transmitted to the seventh data driving IC via the fifth and sixth driving ICs, and so on.

This embodiment reduces a frequency for transmitting image data and keeps the voltage levels of the image data applied to the data driving ICs to be constant, thereby preventing mal-operation.

The first and the second image data are also transmitted in the LVCC type, and a reference voltage for the LVCC provided from a voltage generator can be inputted to all the data driving ICs simultaneously or in sequence.

According to other embodiments of the present invention, the transmission line for transmitting the reference voltage from the voltage generator to the data driving ICs is provided on the TFT panel 200. In this case, it is preferable that the transmission line for the reference voltage is located over the data driving ICs and connected to the voltage generator of the PCB 300 via the transmission film to receive the reference voltage. Alternatively, the reference voltage is inputted to the first data driving IC via the first transmission film like the image data shown in FIG. 2 and shifted to the next data driving IC in sequence.

According to another embodiment of the present invention, the data driver generates the reference voltage based on the gray voltages provided from the voltage generator.

As described above, the embodiments reduce the number of the transmission films and the transmission lines for connecting the PCB and the driving ICs to decrease the manufacturing cost of the LCD including a plurality of data drivers arranged in parallel. The reduction of the transmission lines reduces noise between the transmission lines to decrease the EMI (electromagnetic interference), thereby giving stable data transmission.

Moreover, since the termination resistance is not required, area efficiency increases and the impedance matching to the PCB are not required.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A liquid crystal display comprising:

a liquid crystal panel including a plurality of pixels including switching elements, a plurality of gate lines for transmitting gate signals to the switching elements, and a plurality of data lines for transmitting data voltages to the pixels;

a data driver including a plurality of data driving ICs connected to respective sets of the data lines, receiving image data, and applying the data voltages corresponding to the image data to the data lines; and a gate driver applying the gate signals to the gate lines, wherein the data driving ICs are supplied with a reference voltage, a ground voltage and a supply voltage and voltage levels of the image data swing with respect to the reference voltage lower than the supply voltage.

2. The liquid crystal display of claim 1, wherein the data driving ICs are mounted on the liquid crystal panel.

3. The liquid crystal display of claim 1, wherein the image data received by the data driver are first inputted into at least one of the data driving ICs and shifted to other data driving ICs.

4. The liquid crystal display of claim 3, wherein the data driving ICs include first and second sets of data driving ICs and the image data include first and second image data to be inputted into the first and the second sets of data driving ICs, respectively.

5. The liquid crystal display of claim 4, wherein each of the first and the second sets of data driving ICs includes one data driving IC receiving the image data from an external device.

6. The liquid crystal display of claim 5, wherein the image data for a data driving IC farther from the one data driving IC receiving the image data from the external device precede the image data for a data driving IC closer to the one data driving IC receiving the image data from the external device.

7. The liquid crystal display of claim 1, further comprising a voltage generator for generating the reference voltage to be provided for the data driver and for generating voltages required for the gate signals to be provided for the gate driver.

8. The liquid crystal display of claim 7, wherein the voltage generator generates a plurality of gray voltages to be supplied to the data driver and to be selected as the data voltages.

9. The liquid crystal display of claim 1, wherein the reference voltage is inputted to the data driving ICs simultaneously.

10. The liquid crystal display of claim 1, wherein a signal line for transmitting the reference voltage is provided on the liquid crystal panel.

11. The liquid crystal display of claim 1, wherein the image data have a voltage swing level lower than a voltage swing level of a signal transmitted in TTL/CMOS (transistor-transistor logic/complementary metal oxide semiconductor) transmission.

12. The liquid crystal display of claim 1, wherein the gate driver includes a plurality of gate driving ICs connected to respective sets of gate lines.

13. A method of driving a liquid crystal display including a liquid crystal panel having a plurality of pixels, a plurality of gate lines, and a plurality of data lines, a data driver including a plurality of data driving ICs for supplying data voltages to the data lines, and a gate driver for supplying gate signals to the gate lines, the method comprising:

inputting the image data to at least one of the data driving ICs; and shifting the image data to the data driving ICs, wherein the data driving ICs are supplied with a reference voltage, a ground voltage and a supply voltage and voltage levels of the image data swing with respect to the reference voltage lower than the supply voltage.

14. The method of claim 13, wherein the shift direction of the image data is two.

15. The method of claim 13, wherein the image data has a voltage swing level lower than a voltage swing level of a signal transmitted in TTL/CMOS (transistor-transistor logic/complementary metal oxide semiconductor) transmission.

16. The method of claim 13, wherein the reference voltage is simultaneously inputted to the data driving ICs.

* * * * *